United States Patent [19]

Okafuji et al.

[11] Patent Number: 4,558,480

[45] Date of Patent: Dec. 17, 1985

[54] APPARATUS FOR CLEANING A CURVED GLASS SHEET

[75] Inventors: Masaharu Okafuji, Maizuru; Yoshinori Ochi, Nishinomiya; Atsushi Miyake, Maizuru; Junichi Noguchi, Maizuru; Ichiro Matsuo, Maizuru, all of Japan

[73] Assignee: Nippon Sheet Glass Co., Ltd., Osaka, Japan

[21] Appl. No.: 627,769

[22] Filed: Jul. 5, 1984

[30] Foreign Application Priority Data

Jul. 5, 1983 [JP] Japan ..... 58-122197

[51] Int. Cl.[4] ..... A46B 13/02

[52] U.S. Cl. ..... 15/77; 51/2 B; 51/74 R; 134/6

[58] Field of Search ..... 15/77, 102, 312 R, 4; 51/2 B, 22, 72 R, 72 L, 74 R, 98 R; 134/6

[56] References Cited

U.S. PATENT DOCUMENTS

| | | | |
|---|---|---|---|
| 2,380,550 | 7/1945 | Reed | 15/77 X |
| 2,781,534 | 2/1957 | Cochran et al. | 15/77 |
| 2,831,791 | 4/1958 | Downes et al. | 156/103 |
| 2,926,371 | 3/1960 | Swindler | 15/77 |
| 2,951,254 | 9/1960 | Cole et al. | 15/77 X |
| 3,054,344 | 9/1962 | Boicey et al. | 100/169 |
| 3,146,696 | 9/1964 | Madge | 100/155 G |
| 3,351,001 | 4/1965 | Achkio | 100/176 |
| 3,694,636 | 9/1972 | Smith, Jr. | 364/476 |

FOREIGN PATENT DOCUMENTS

| | | | |
|---|---|---|---|
| 576344 | 5/1959 | Canada | 156/102 |
| 784558 | 10/1957 | United Kingdom | 156/358 |

*Primary Examiner*—Edward L. Roberts

*Attorney, Agent, or Firm*—Fitzpatrick, Cella, Harper & Scinto

[57] ABSTRACT

A method and apparatus of cleaning with a roll brush a three-dimensional surface of a curved glass sheet. Levels at both ends of a rotating shaft of the roll brush are independently controlled and an inclination angle of a support frame of the roll brush about the rotating shaft of said roll brush is controlled when the roll brush is moved along the three-dimensional surface. The posture of the roll brush is controlled in such a manner that the rotating shaft of the roll brush becomes substantially parallel to the three-dimensional surface and that a roll brush extended opening of the support frame surrounding said roll brush is directed in a direction substantially normal to the three-dimensional surface. The posture control of the roll brush is carried out in accordance with prestored data sampled along the curved surface of the glass sheet.

13 Claims, 14 Drawing Figures

APPARATUS FOR CLEANING A CURVED GLASS SHEET

CROSS REFERENCE TO RELATED APPLICATIONS

This application discloses subject matter disclosed in copending application Ser. No. 627,858 filed July 5, 1984 in the names of the same inventors and entitled METHOD AND APPARATUS FOR PRESSING LAMINATED GLASS.

BACKGROUND OF THE INVENTION

1. Field of the Invention

The present invention relates to a cleaning method and apparatus for a curved glass sheet used in an adhesion process for adhering laminated glass (safety glass) such as a windshield of a vehicle.

2. Description of the Prior Art

In a conventional windshield of a vehicle, a plurality of sheets of plate glass are adhered together through a plastic film such as a polyvinyl butyral film to prepare so-called safety glass. Such laminated glass is prepared such that the overlapped sheets of plate glass are heated to be formed into a desired shape, and that an adhesion interlayer is inserted between the separated curved sheets of plate glass and the resultant structure is subjected to adhesion. In order to easily separate the curved sheets of plate glass, diatomaceous earth particles or the like are sprinkled between the sheets of plate glass. Before the adhesion interlayer is inserted between the curved glass sheets, cleaning must be performed to remove all the diatomaceous earth particles from the surfaces of the curved glass sheets which are to be subjected to adhesion. In principle, according to dry cleaning, a roll brush is rotated and is brought into slidable contact with the curved glass surface so as to clean it. A conventional cleaning apparatus of this type basically comprises a drive mechanism of the roll brush, a moving mechanism for feeding the roll brush along the curved glass surface, and a vacuum suction mechanism for removing diatomaceous earth particles from the glass surface. The moving mechanism has a guide cam mechanism for moving the brush along the curved surface of the glass sheet. Whenever the shape of the glass sheet changes corresponding to a windshield of a different type of vehicle, the guide cam must be replaced with the one that is compatible with the new glass sheet shape. Thus, this cleaning apparatus is not suitable for cleaning different types of curved glass sheets. In addition, vehicle windshields have a complicated three-dimensional surface wherein the radius of curvature at the upper side differs from that at the lower side. As a result, the entire area of the front glass cannot be uniformly brushed in accordance with the roll brush movement controlled by the guide cam. In addition to this disadvantage, it is essentially difficult to control a flexible roll brush in accordance with a rigid guide cam. The guide cam cannot provide highly precise and uniform brushing, thus degrading the cleaning precision. The roll brush is brought into nonuniform contact with the glass surface, so the brush life is shortened and the brushing state is deteriorated, resulting in inconvenience over time. When the brush is reciprocated along the glass surface, the locus of the brush along the forward direction differs from that along the reverse direction due to mechanical play of the roll brush moving mechanism and undershooting or overshooting of the servo mechanism. Therefore, at present, even if the prescribed brushing operation can be performed along the active direction, the same result as in the active direction may not be obtained along the inactive direction.

SUMMARY OF THE INVENTION

It is an object of the present invention to provide a cleaning method and apparatus wherein an entire surface of a glass sheet having a complicated three-dimensional surface can be uniformly brushed without using a guide cam.

It is another object of this invention to provide the cleaning method and apparatus wherein the brush can be properly brought into contact with the glass surface with good reproducibility as is preset.

It is a further, object of this invention to provide the cleaning method and apparatus wherein trace factors for the glass surface on reciprocal cleaning operation are independently determined to guide the roll brush along the forward direction and the reverse direction, thereby performing satisfactory reciprocal cleaning.

It is still further object of this invention to provide the cleaning method and apparatus wherein the cleaning efficiency for glass sheets having different three-dimensional surface is greatly improved by basing on control data preset in accordance with curved surfaces of respective different types of glass sheet.

In order to achieve above objects of the present invention, there is provided a roll brush for brushing a surface of a curved glass sheet. Levels at both ends of a rotating shaft of the roll brush are independently controlled and an inclination angle of a support frame of said roll brush about said rotating shaft of said roll brush is controlled when said roll brush is moved along the three-dimensional surface. The posture of said roll brush is controlled in such a manner that said rotating shaft of said roll brush becomes substantially parallel to the three-dimensional surface and that a roll brush extended opening of said support frame surrounding said roll brush is directed in a direction substantially normal to the three-dimensional surface. The level control at both ends of a rotating shaft of the roll brush, the angular displacement of the support frame and relative movement between the roll brush and the curved glass sheet are controlled by numerical control in accordance with predetermined data. The data represents the three-dimensional surface of the curved glass sheet, so that a curved surface guide capability can be provided leading to a high cleaning performance. In addition to this advantage, the cleaning apparatus without even partial modification can clean all types of curved glass sheets having different three-dimensional surfaces in accordance with the prestored data.

Other and further objects of the invention will become obvious upon an understanding of the illustrative embodiments about to be described or will be indicated in the appended claims, and various advantages not referred to herein will occur to one skilled in the art upon employment of the invention in practice.

DETAILED DESCRIPTION OF THE PREFERRED EMBODIMENT

The present invention will be described in detail with reference to a preferred embodiment.

Figure 1:
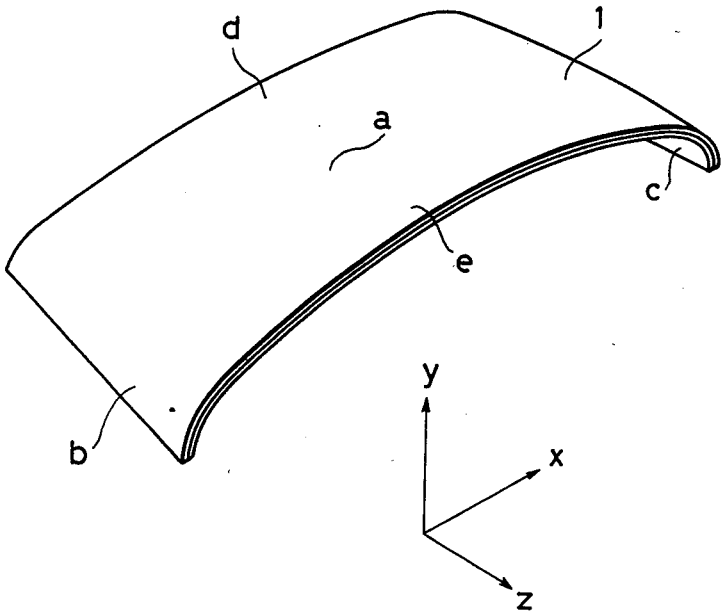
FIG. 1 is a perspective view of overlapping curved glass sheets which when adhered together constitute a windshield of a vehicle and which are subjected to cleaning.

FIG. 1 is a perspective view of overlapping curved glass sheets which when adhered together constitute a windshield of a vehicle and which are subjected to cleaning. Two glass sheets 1 typically have a complicated three-dimensional surface curved along x-, y- and z-axes. A central portion a of the glass sheets 1 is substantially flat, and two wing portions b and c are greatly bent. An intermediate portion from the wing portion b to the wing portion c is moderately bent in a convex shape. The radius of curvature in an upper side portion d is different from that in a lower side portion e. An intermediate portion from the upper side portion d to the lower side portion e is moderately bent.

Figure 2:
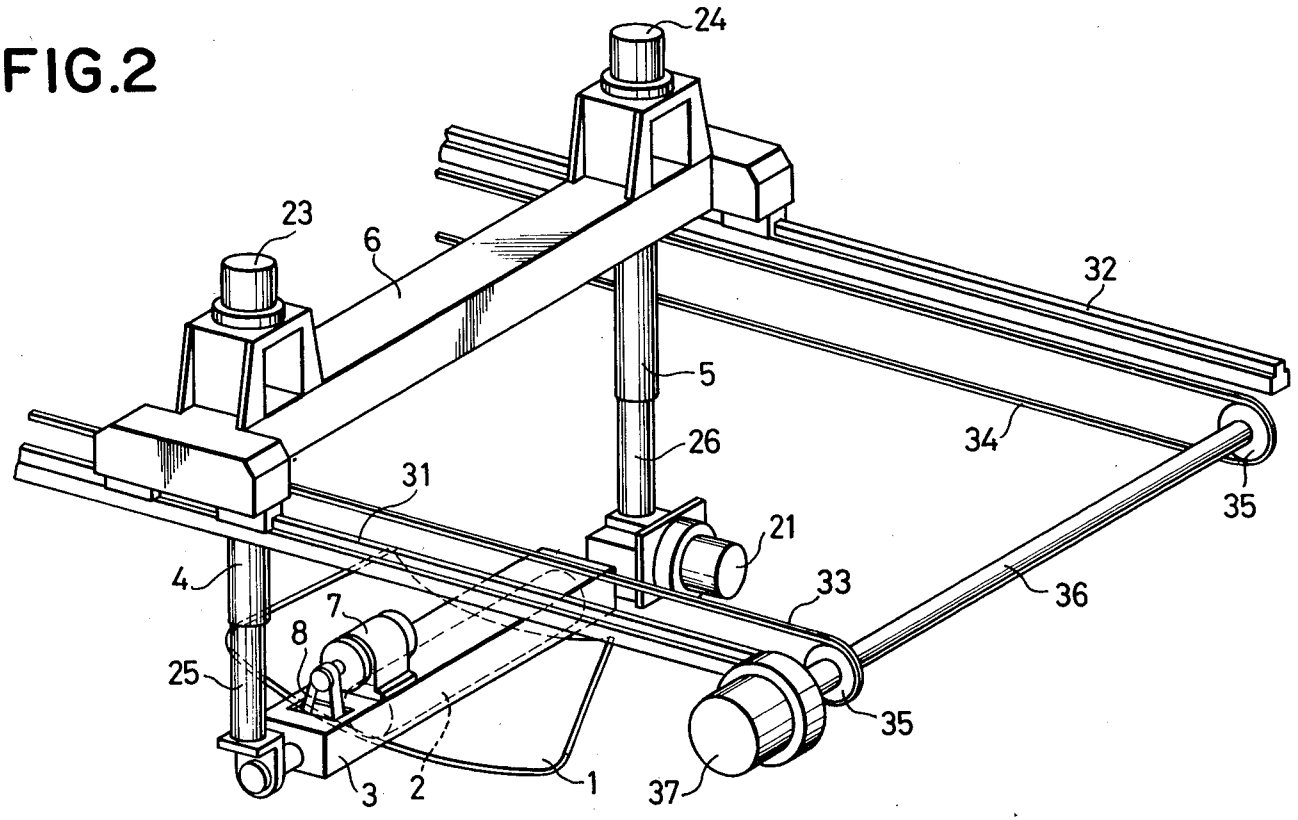
FIG. 2 is a perspective view schematically showing a cleaning apparatus according to an embodiment of the present invention.

The overlapping curved glass sheets 1 shown in FIG. 1 are separated into two curved glass sheets whose adhesion surfaces are cleaned by the cleaning apparatus shown in FIG. 2 before an adhesion interlayer is inserted therebetween.

Figure 3:
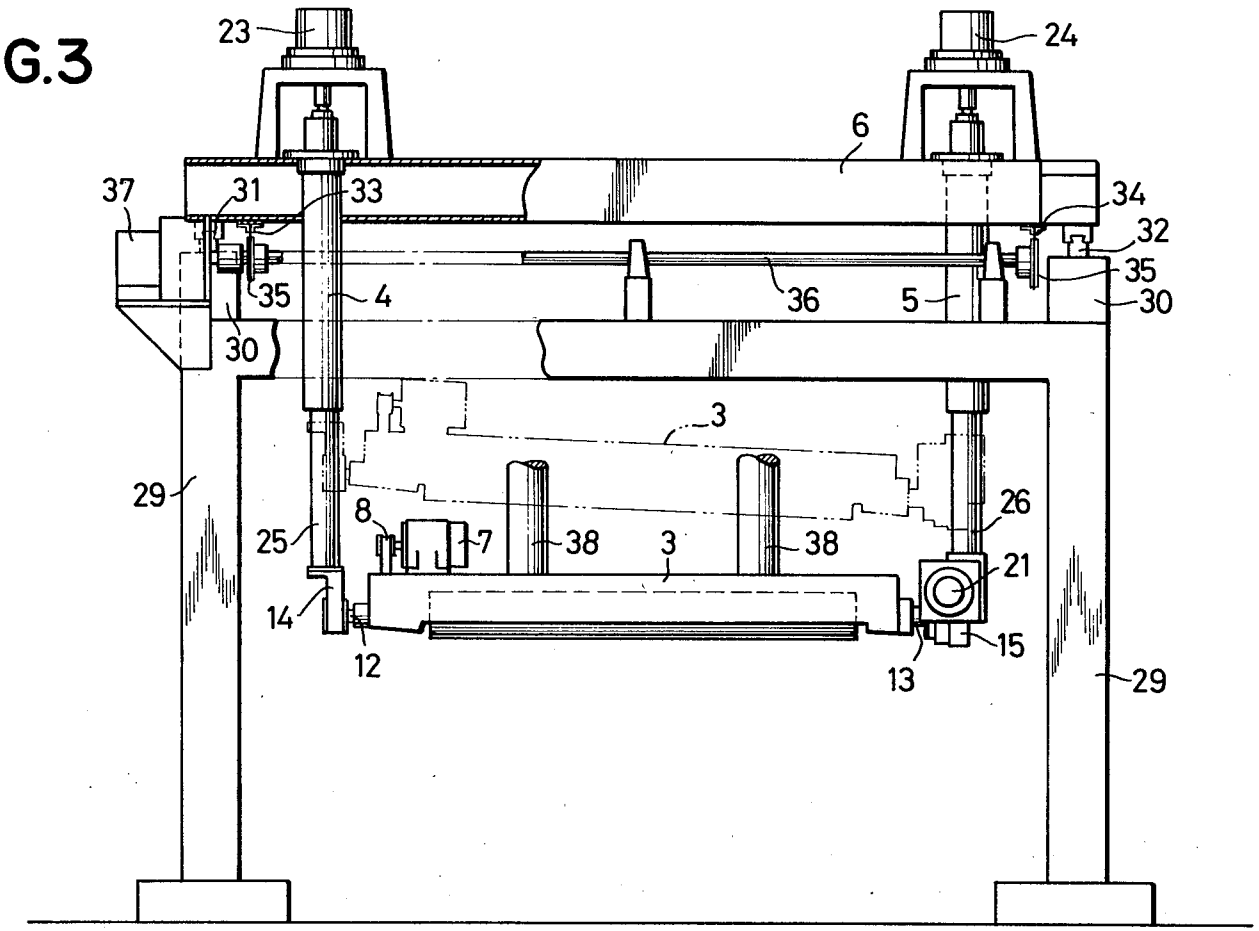
FIG. 3 is a front view of the cleaning apparatus shown in FIG. 2.
Figure 4:
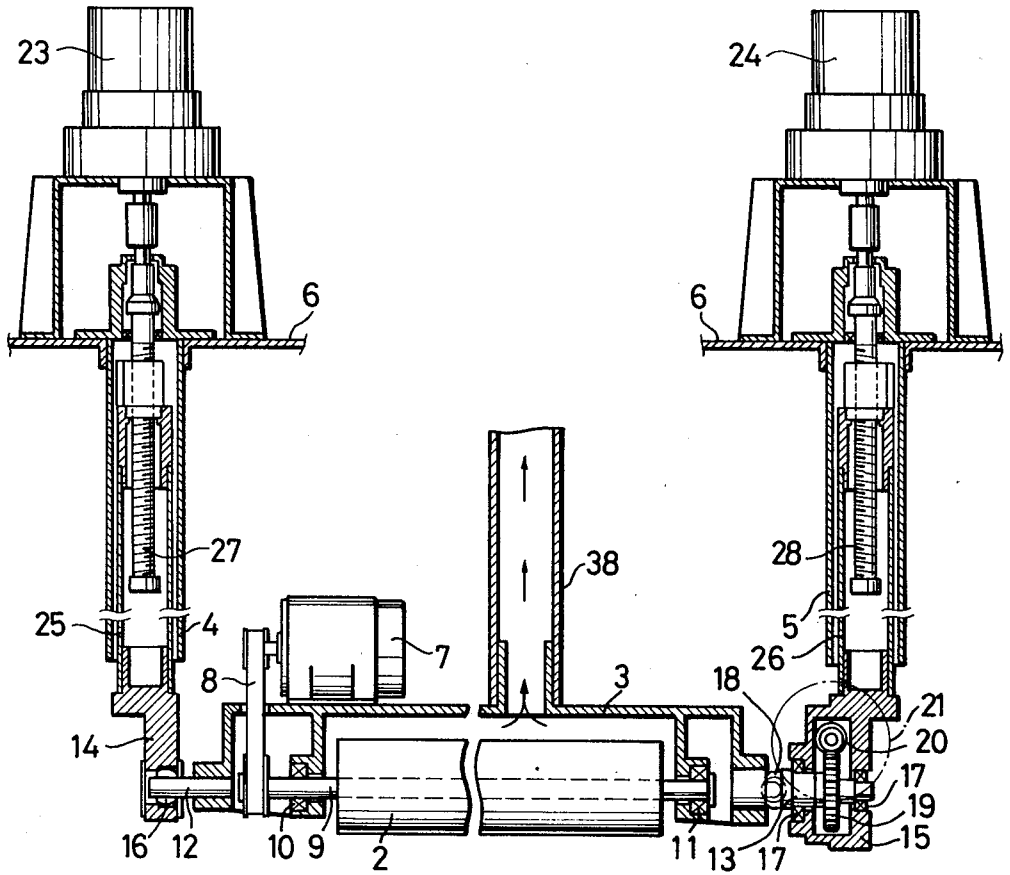
FIG. 4 is a partial sectional view showing the detailed construction of the cleaning apparatus of FIG. 3.
Figure 5:
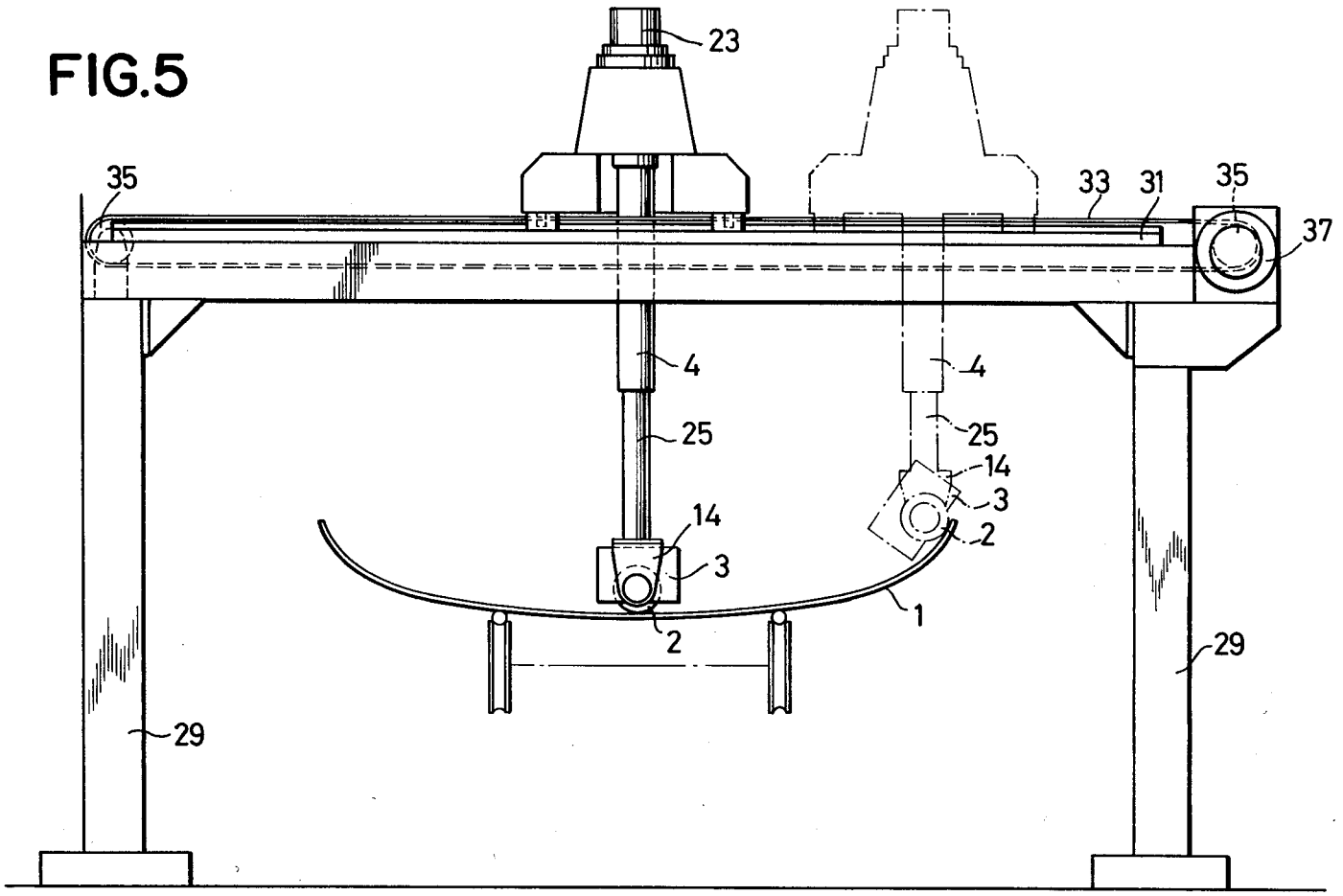
FIG. 5 is a side view of the cleaning apparatus of FIG. 2.

FIG. 2 is a perspective view schematically showing the cleaning apparatus, FIG. 3 is a front view thereof, FIG. 4 is a partial longitudinal sectional view showing the detailed construction of the main part thereof, and FIG. 5 is a side view showing the cleaning operation of the cleaning apparatus.

As shown in FIG. 2, the cleaning apparatus basically comprises a roll brush 2, a roll brush support frame 3, a pair of suspension arms 4 and 5 for suspending both ends of the support frame 3, and a moving frame 6 for holding the proximal ends of the suspension arms 4 and 5 and moving the roll brush 2 along the three-dimensional surface of the curved glass sheet 1.

The roll brush 2 is rotatably driven through a belt 8 by a drive motor 7 mounted on the support frame 3, as shown in FIG. 4. The support frame 3 which supports both the ends of a shaft 9 of the roll brush 2 through bearings 10 and 11 is supported at lower ends 14 and 15 of the suspension arms 4 and 5 by bearings 16 and 17 and is pivotal about shafts 12 and 13 having axes corresponding to an extended line of the shaft 9 of the roll brush 2. The bearing 16 which receives the shaft 12 of the support frame 3 comprises a self-aligning spherical bearing. The shaft 13 is coupled to the support frame 3 through a universal joint 18. Therefore, the roll brush 2 can be freely inclined with respect to the horizontal plane so as to be parallel to the surface of the glass sheet 1.

The shaft 13 of the support frame 3 is coupled to a drive motor 21 through a worm wheel 19 and a worm 20, and the rotational angle (swinging angle) of the support frame 3 is controlled by the motor 21 such that the bottom opening (roll brush extending side) of the support frame 3 is constantly directed normal to the glass surface in accordance with the three-dimensional pattern of the curved glass sheet as indicated by the alternate long and short dashed line of FIG. 5.

The lengths of the suspension arms 4 and 5 for suspending both ends of the support frame 3 can be independently controlled by drive motors 23 and 24 mounted on the moving frame 6. In other words, movable rods 25 and 26 within the suspension arms 4 and 5 can be extended/withdrawn with respect to the suspension arms 4 and 5 by means of screw rods 27 and 28 connected to the drive motors 23 and 24, respectively. Therefore, the level of the roll brush 2 and its inclined angle with respect to the horizontal plane are controlled such that the roll brush 2 is moved along the three-dimensional surface of the curved glass sheet 1, as indicated by the alternate long and two dashed line of FIG. 3.

As shown in FIGS. 3 and 5, the moving frame 6 fixed with the suspension arms 4 and 5 is horizontally guided along a pair of rails 31 on a beam 30 supported by four columns 29. The moving frame 6 is horizontally moved by a drive motor 37 through chains 33 and 34, a sprocket 35 and a drive shaft 36. Therefore, the roll brush 2 can be moved on the three-dimensional surface of the curved glass sheet 1 along the x-axis of FIG. 1. Therefore, in principle, the roll brush 2 can be moved relative to the curved glass sheet 1. The position of the roll brush 2 may be fixed, and the support table of the curved glass sheet 1 may be horizonatally moved.

A suction pipe 38 of a vacuum suction mechanism (not shown) is connected to the upper surface of the support frame 3 which surrounds the roll brush 2. Particles removed by the roll brush 2 are drawn by the suction mechanism, as indicated by arrows in FIG. 4.

Brushing (cleaning) of the curved glass sheet 1 is performed by 4-axis control: (a) horizontal (x-axis) control of the roll brush 2 on the glass surface; (b) and (c) y-axis (ya and yb axes) control for independently controlling the level of both ends of the roll brush 2 and the inclination angle of the roll brush 2 so as to follow the three-dimensional shape of the glass surface; and (d) angle control for pivoting the support frame 3 such that the roll extending opening of the support frame 3 is directed normal to the glass surface. The x-, ya- yb- and $\theta$-axes are controlled by an NC machine so as to match the shape of the curved glass sheet 1 in accordance with the prestored data.

The cleaning apparatus cleans one of the two curved glass sheets which is to be subjected to adhesion, as shown in FIGS. 2 to 5. Another cleaning apparatus having the same construction of the apparatus of FIGS. 2 to 5 is prepared to clean the other curved glass sheet to be subjected to adhesion to the first curved glass sheet. The curved glass sheets synchronously cleaned by the separate cleaning apparatuses overlap each other through an adhesion interlayer, and a resultant structure is subjected to preliminary adhesion.

Figure 6:
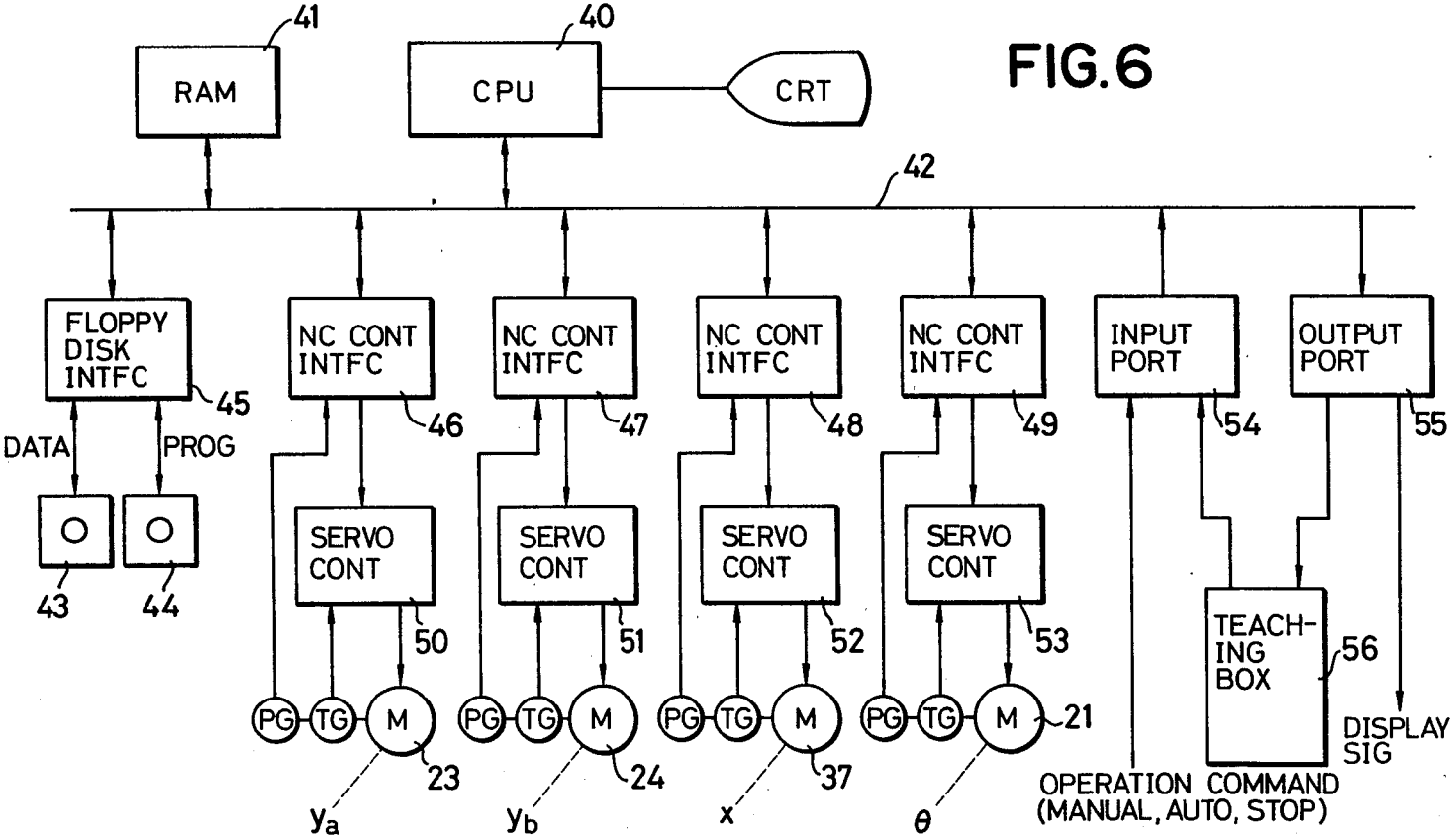
FIG. 6 is a block diagram of a control section of the cleaning apparatus of FIG. 2.

FIG. 6 is a block diagram of a control section of the cleaning apparatus according to the present invention. Referring to FIG. 6, the control section comprises a microcomputer having a CPU 40, a RAM 41 and a data bus 42. The control section is connected to the cleaning apparatus of FIGS. 2 to 6 through a plurality of interfaces. The control data and the control program are stored in a data floppy disk 43 and a program floppy disk 44, respectively, to control the level (ya and yb axes) of both the ends of the roll brush 2, the horizontal translational control (x-axis) and the angle control ( -axis) of the roll brush support frame 3. The data read out from the floppy disks 43 and 44 are stored in the RAM 41 through a floppy disk interface 45. When cleaning is performed, the CPU 40 is operated in accordance with the program stored in the RAM 41, so that data are sequentially read out from the RAM 41 and are supplied to NC control interfaces 46 to 49. Servo controllers 50 to 53 are operated in response to the control outputs from the NC control interfaces 46 to 49. The drive motors 23 and 24 (ya- and yb-axis control) are driven to extend/withdraw the movable rods 25 and 26 of the suspension arms 4 and 5. The drive motor 37 (x-axis control) is driven to control the position of the moving frame 6. The drive motor 21 ($\theta$-axis control) is driven to swing the roll brush support frame 3. The same control section as described above is connected to the other cleaning apparatus which is paired with the cleaning apparatus of FIGS. 2 to 5 and has the same NC control interfaces and servo controllers as those of FIG. 6. The NC control interfaces and the servo controllers (not shown) of the other cleaning apparatus are connected to the data bus 42.

Tachogenerators TG and pulse generators PG are connected to the motors 23, 24, 37 and 21, respectively. The outputs from the tachogenerators TG are fed back to the servo controllers 50 to 53, so that the respective motors are driven at specified speeds. Outputs generated by the pulse generators PG at every unit rotational angle of the respective motors 23, 24, 37 and 21 are fed back to the NC control interfaces 46 to 49, respectively. Therefore, NC control for the level (ya and yb) at both ends of the support frame 3, the horizontal position (x), and the rotational angle ($\theta$) is performed in accordance with the outputs from the pulse generators PG and the control data supplied from the CPU 40. The control data represents 20 sampling points of the curved glass sheet 1 along the x-axis. The NC control interfaces 46 to 49 perform interpolation (primary or secondary interpolation) between every two adjacent sampling points in the same manner as in the conventional NC machine.

An input port 54 receives operation command inputs (e.g., automatic, manual and stop commands) of the apparatus and an output port 55 outputs display signals to monitor lamps for indicating the operating state. A teaching box 56 is coupled to the input and output ports 54 and 55, so that the command or instruction data for teaching (to be described later) are supplied to the NC control interfaces 46 to 49 through the CPU 40.

The teaching operation of the cleaning apparatus will be described. The cleaning apparatus described above has a property of flexibility and can therefore be used for a curved glass sheet having substantially any three-dimensional surface. The necessary specific cleaning operation can first be taught for individual curved glass sheets having different three-dimensional surfaces. When the apparatus learns all the different three-dimensional surfaces of the curved glass sheets, complete play back can be performed. In addition, the control data obtained by learning the different three-dimensional surfaces can then be selectively used to perform cleaning of various type of curved glass sheet having different three-dimensional surfaces.

Figure 7A:
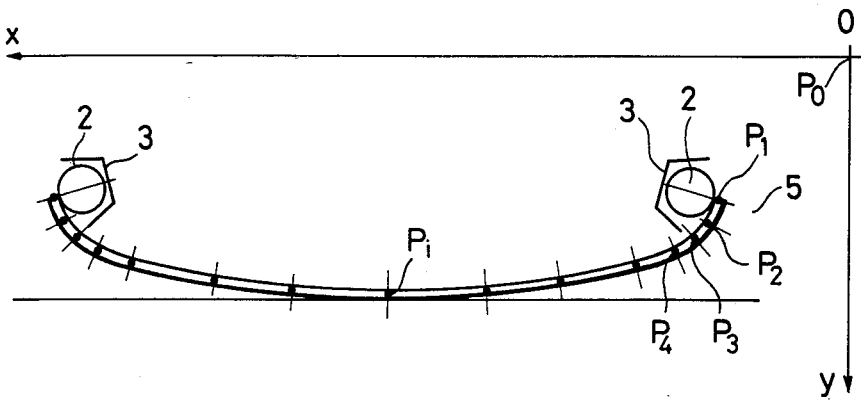
FIG. 7A is a sectional view of the curved glass sheet so as to show sampling points for teaching.
Figure 7B:
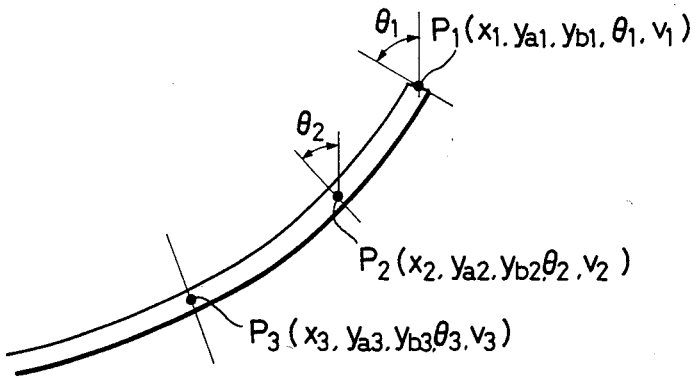
FIG. 7B is an enlarged sectional view showing part of the curved glass sheet of FIG. 12A.

The teaching operation is performed by using 15 to 20 sampling points $P_0$, $P_1$, . . . along a cross section of the curved glass sheet 1, as shown in FIGS. 7A and 7B. The position of each sampling point is represented by absolute coordinates with respect to an origin O in the x-y coordinate system. More specifically, the x coordinates ($x_1$, $x_2$, $x_3$, . . . ) represent the horizontal positions of the moving frame 6. The y coordinates ($y_{a1}$, $y_{a2}$, . . . , and $y_{b1}$, $y_{b2}$, . . . ) represent levels at both ends of the roll brush 2. Teaching data also include angle data ($\theta_1$, $\theta_2$, . . . ) of the support frame 3 and moving velocity data ($v_1$, $v_2$, . . . ) of the roll brush 2, in addition to the above-mentioned x- and y-coordinate data. Therefore, the respective sampling points are defined by the following teaching data:

$$P_1(x_1, y_{a1}, y_{b1}, \theta_1, v_1)$$
$$P_2(x_2, y_{a2}, y_{b2}, \theta_2, v_2)$$
$$\vdots$$
$$P_i(x_i, y_{ai}, y_{bi}, \theta_i, v_i)$$
$$\vdots$$

The teaching data of each sampling point of FIG. 7A is supplied to the CPU 54 every time teaching is performed and is stored in a memory table of the RAM 41. It should be noted that the real storage data in the RAM 41 is count data corresponding to the PG outputs from the pulse generators of the motor 37 for the moving frame 6, the motors 23 and 24 for the suspension arms 4 and 5, and the motor 21 for the roll brush support frame 3 with respect to the reference position, excluding the moving velocity data of the roll brush 2. The moving velocity data ($v_1$, $v_2$, . . . ) is arbitrarily preset in accordance with the command from the teaching box 56. The roll brush 2 is moved at a low velocity when the radius of curvature of the curved glass sheet 1 is large, but is moved at a high velocity when the radius of curvature of the curved glass sheet is small.

When the roll brush 2 reciprocates to clean the surface of the curved glass sheet, sampling point data from the end point $P_n$ to the start point $P_1$ are added. In this manner, since the roll brush 2 can be controlled in accordance with different sequences of data along the forward and reverse directions, the play of the mechanical drive system and the tracking delay of the electric drive system do not cause interference during movement along the forward and reverse directions. Therefore, the control along the forward direction is independent of that along the reverse direction, while the play, the error and delay are all compensated for. As a result, satisfactory cleaning along both the forward and reverse directions can be performed, thereby improving the productivity.

In the cleaning mode (playback mode), the respective teaching data are supplied to the NC control interfaces 46 to 49 so as to perform 4-axis NC control in synchronism with the outputs from the PGs of the respective motors 23, 24, 37 and 21. The velocity data is supplied as a pulse rate (frequency) of a reference pulse generator of each NC control interface so as to distribute the reference pulses in accordance with a ratio of the relative x- and y-coordinate data of the sampling point $P_i$ to those of the adjacent sampling point $P_{i+1}$. The drive motors 23, 24 and 37 are controlled in accordance with the distributed pulses representing the x- and y-velocity components in such a manner that the roll brush 2 is moved from the sampling point $P_i$ to the sampling point $P_{i+1}$. On the other hand, the motor 21 is driven in accordance with the angle data $\theta$ independent of the x- and y-axes. The interpolation between the two adjacent sampling points can be linear or arc interpolation.

Figure 8:
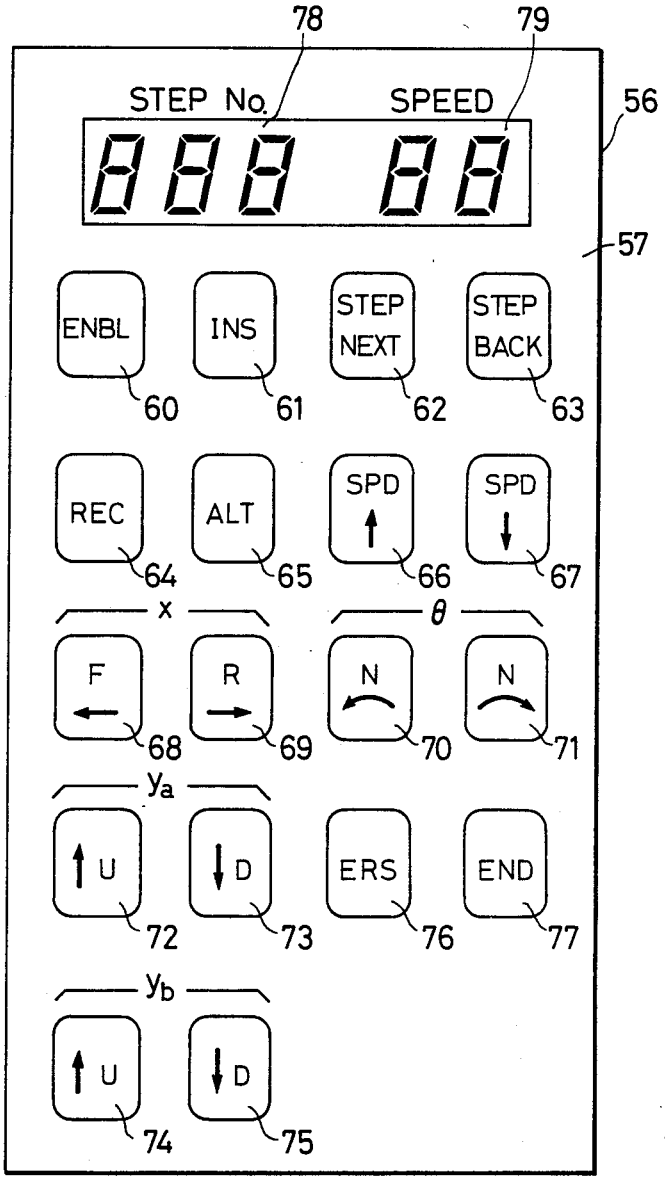
FIG. 8 is a front view of an operation panel of a teaching box.
Figure 9A:
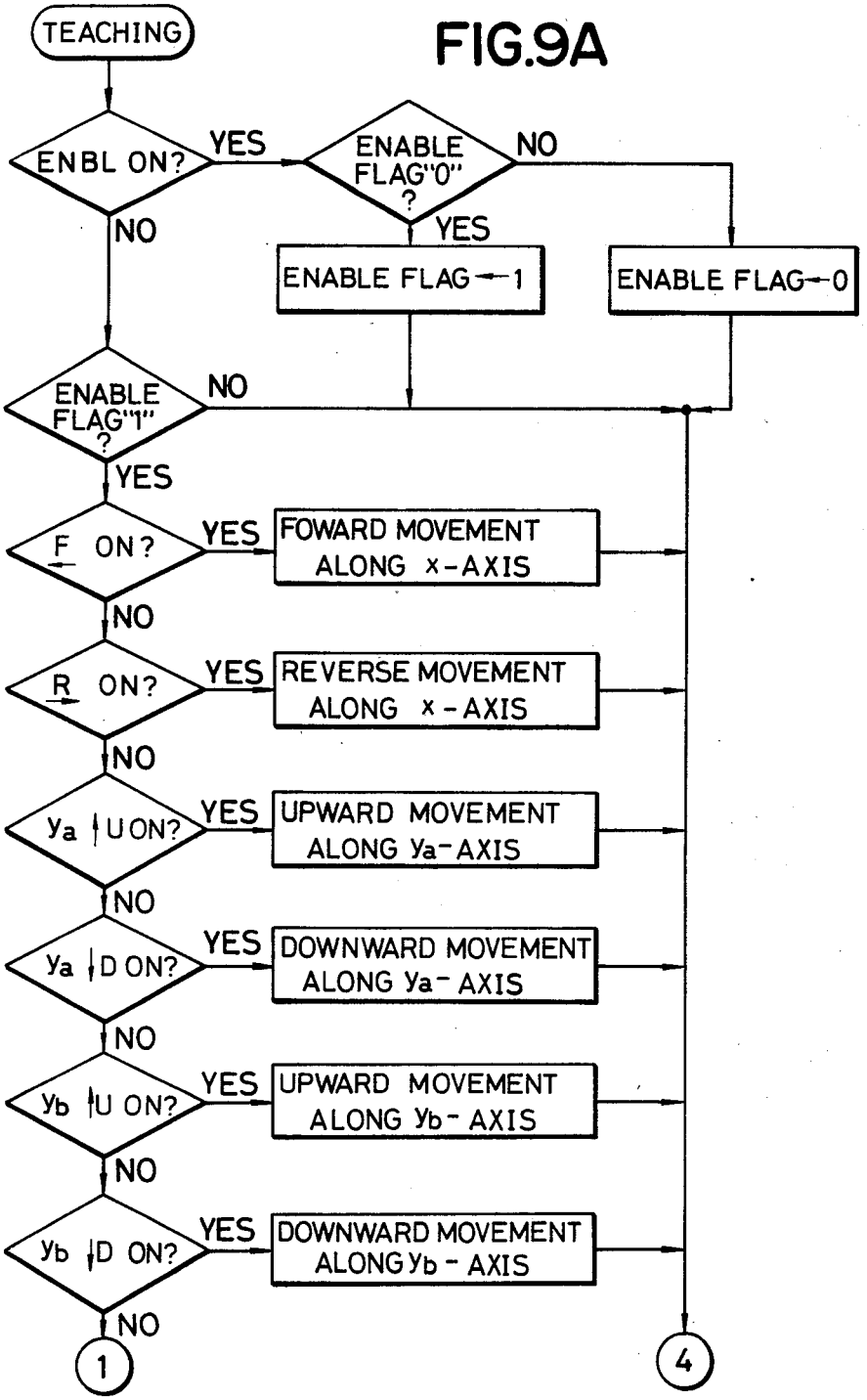
FIGS. 9A to 9C are respectively flow charts for explaining the teaching operation.
Figure 9B:
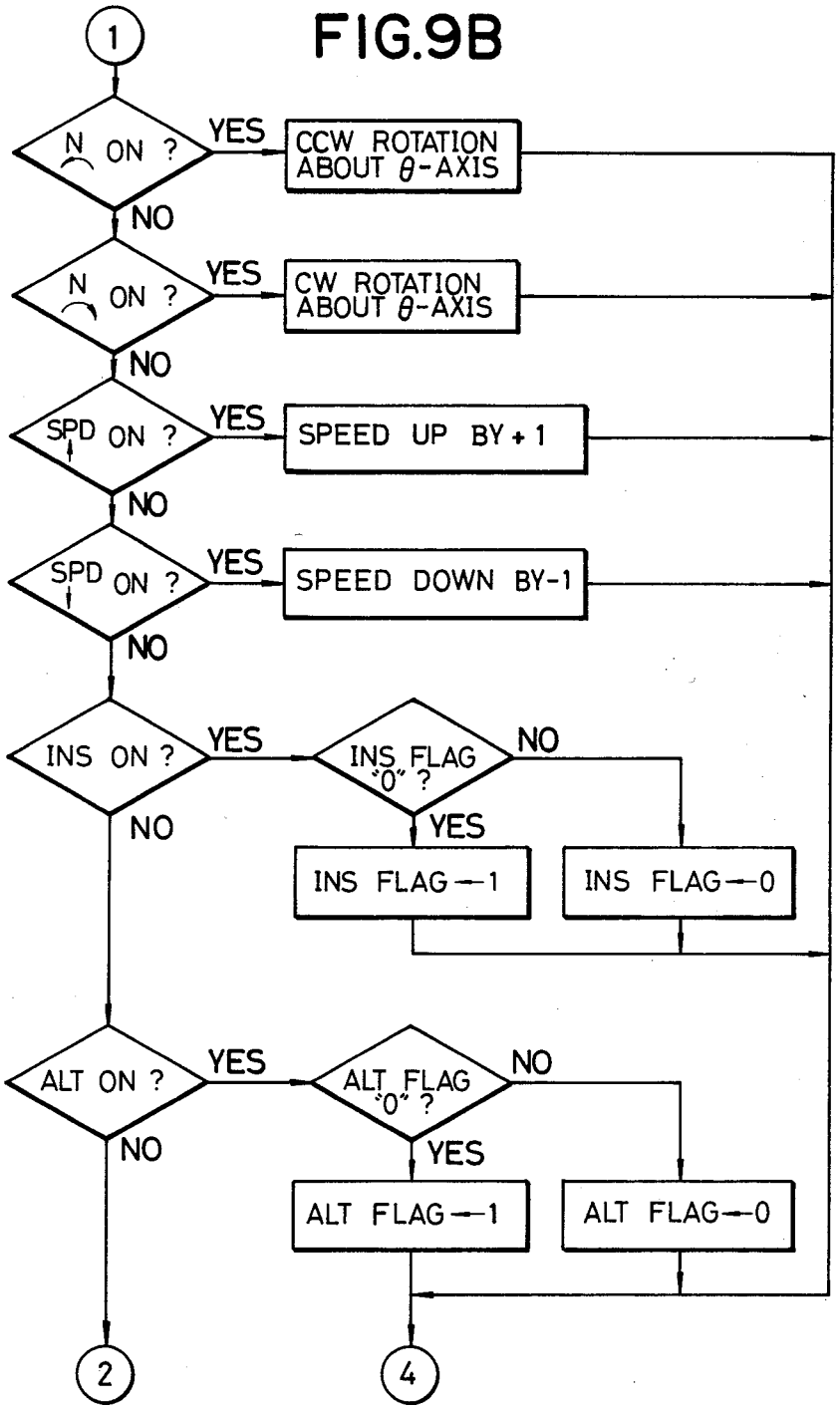
Figure 9C:
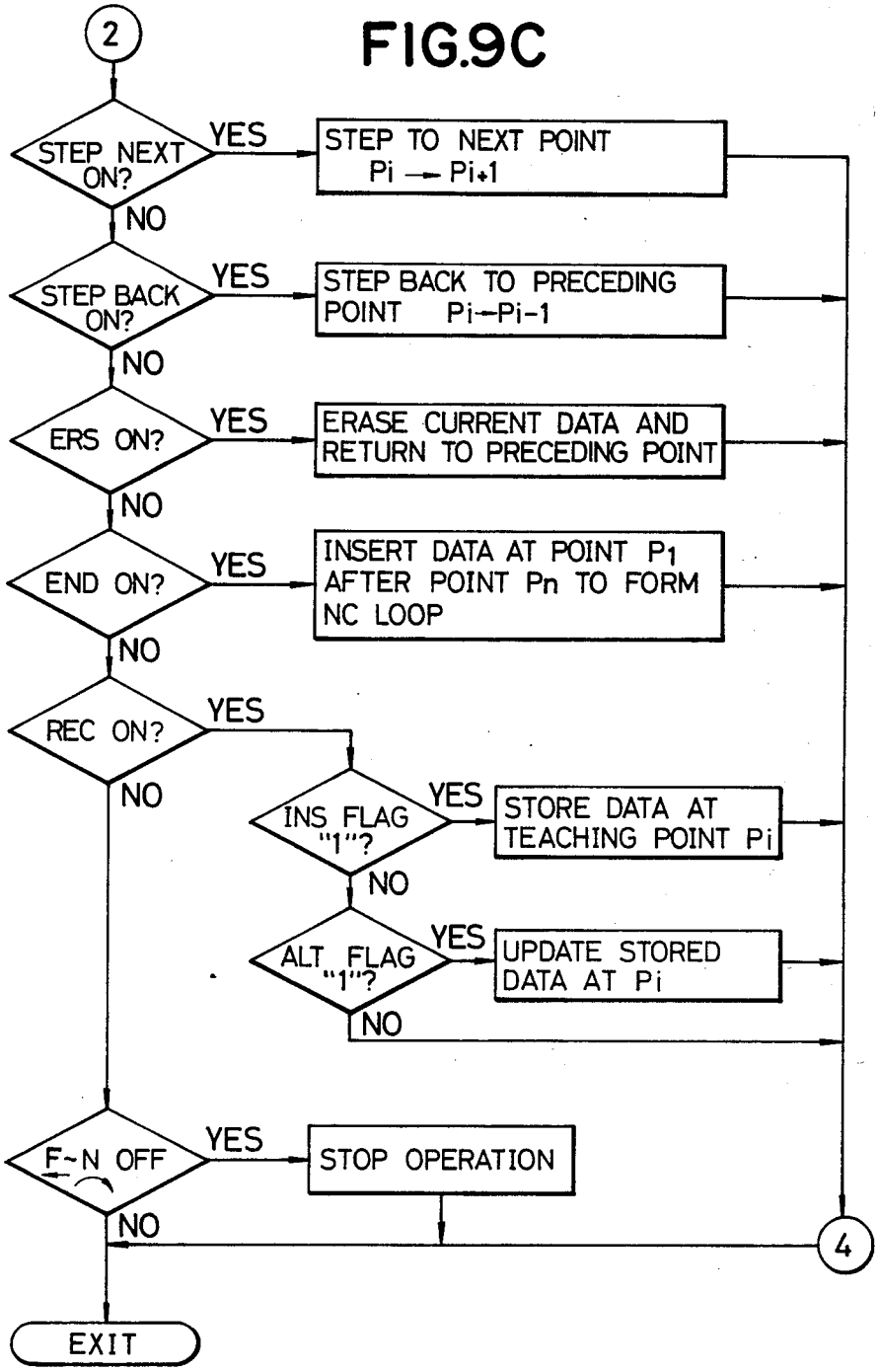

FIG. 8 is a plan view of an operation panel 57 of the teaching box 56. FIGS. 9A to 9C are respectively flow charts for explaining the teaching operation. The teaching box 56 is started when an ENBL (enable) key 60 is depressed and an enable flag is set at logic "1" to enable key input operations by other keys. However, when the enable flag is set at logic "0", the key input operations by other keys are disabled. When an F (forward) key 68 or an R (reverse key) 69 is depressed, the moving frame 6 is moved in the forward or reverse direction. The keys 68 and 69 are used to select an x coordinate. A ↑ U (up) key 72 or a ↓ D (down) key 73 for the $y_a$-axis and a ↑ U (up) key 74 or a ↓ D (down) key 75 for the $y_b$-axis are depressed to extend/withdraw the movable rods 25 and 26 of the suspension arms 4 and 5, thereby selecting $y_a$ and $y_b$ coordinates. When an N (counterclockwise) key 70 or an N (clockwise) key 71 is depressed the inclination angle $\theta$ (swinging angle) of the roll brush support frame 3 is preset. The moving velocity of the roll brush 2 can be controlled by an SPD ↑ (speed up) key 66 or an SPD ↓ (speed down) key 67 in, for example, 16 steps. The velocity data is displayed on a display 79.

When the data $(x_i, y_{ai}, y_{bi}, \theta_i, v_i)$ of the sampling point $P_i$ are preset in accordance with the series of operations described above, an INS (insert) key 61 and an REC (record) key 64 are depressed to store the data of the sampling point $P_i$ in the RAM 41 through the CPU 40. As shown in FIG. 9B, when the INS key 61 is depressed, an INS flag is set at logic "1". Subsequently, when the REC key 64 is depressed, as shown in FIG. 9C, the data of the sampling point $P_i$ are be stored in the RAM 41. In this case, when the previous data of the sampling point $P_i$ are still stored in the RAM 41, an ALT (alter) key 65 is depressed to set an ALT flag at logic "1". Thereafter, when the REC key 64 is depressed, the data of the sampling point $P_i$ are updated. This teaching process is used to correct the locus of the roll brush.

In order to preset the teaching data of the next teaching point $P_{i+1}$ after the teaching of the sampling point $P_i$ is finished, a STEP NEXT (step next) key 62 is depressed, as shown in FIG. 9C. On the other hand, in order to return to the previous step, a STEP BACK (step back) key 63 is depressed. The current step number (reference number of the sampling point P) is displayed on a display 78 in the operation panel 57. When an ERS (erase) key 76 is depressed, the storage data of the sampling point $P_i$ are erased, and the teaching point position is returned to the immediately preceding point. When teaching of the last sampling point is finished, an END (end) key 77 is depressed, thereby inserting the data of the start sampling point $P_1$ after the data of the end sampling point $P_n$, as shown in FIG. 9C. In other words, the following loop is formed, and the NC operation loop is completed.

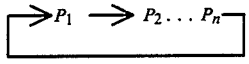

This loop is executed (played back) to perform cleaning along the active direction. In practice, by observing the contact state between the curved glass sheet 1 and the roll brush 2, the data of the respective points are updated to determine the final locus. Similarly, the data (point $P_n$ to point $P_1$) along the reverse direction can be determined, thereby completing teaching.

The NC control data stored by the teaching operation described above are stored in the floppy disk 43 in units of curved glass sheets 1. These glass sheets 1 have different three-dimensional surfaces. Every time the type of glass sheet to be cleaned changes, the corresponding data are read out from the floppy disk 43 and are stored in the RAM 41, thereby reproducing (playing back) the learned cleaning process in accordance with NC control.

Figure 10:
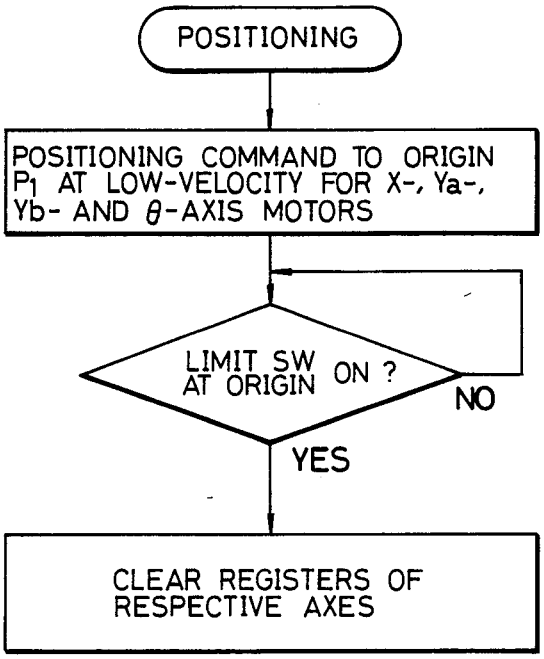
FIGS. 10 and 11 are respectively flow charts for explaining the NC (numerical control) operation.
Figure 11:
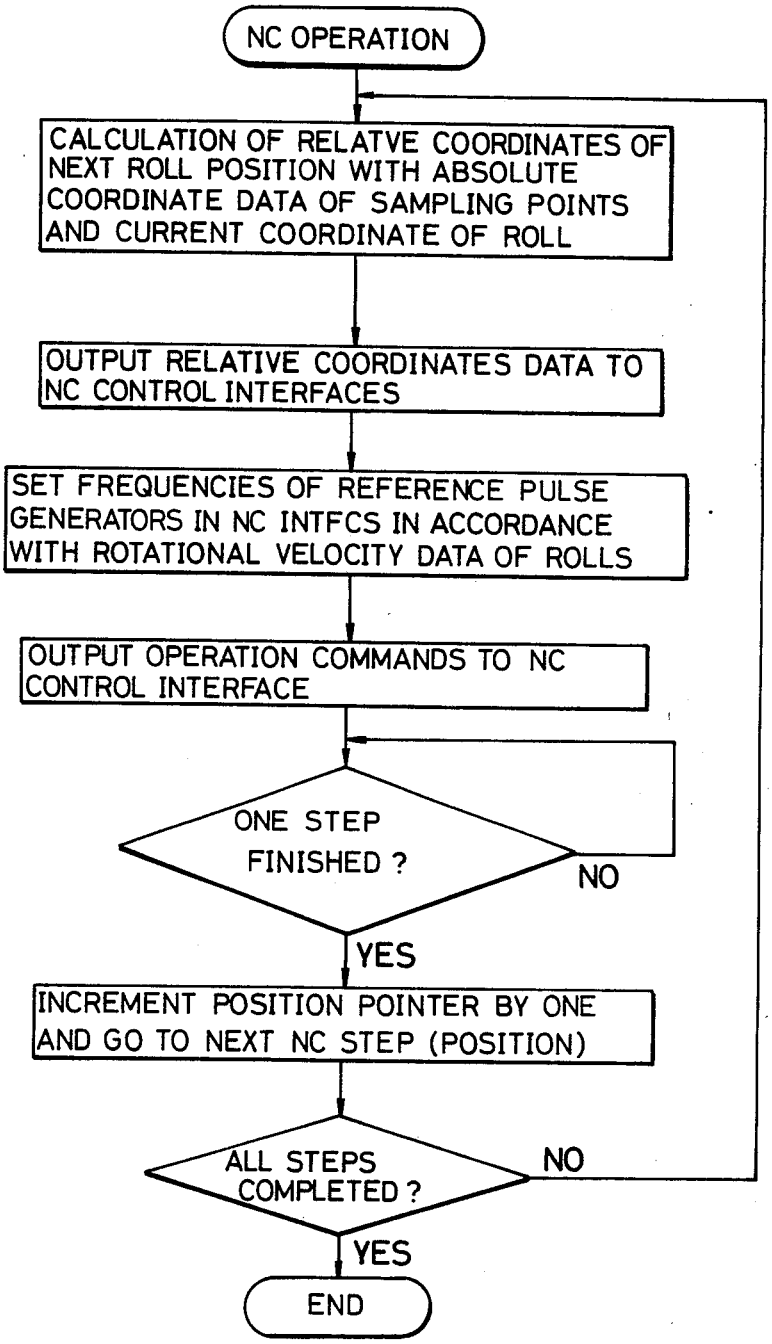

FIGS. 10 and 11 are respectively flow charts for explaining the NC control of the cleaning operation. Low-velocity commands are supplied to the x-, $y_a$-, $y_b$- and $\theta$-axis motors so as to position the roll brush 2 at the origin $P_1$ of FIG. 7A, as shown in FIG. 10. When the limit switch corresponding to the origin is turned on, the respective motors are stopped. The registers of the respective axes in the CPU 40 are cleared. Since the absolute coordinate data of the respective sampling points for teaching are stored in th RAM 41, the next relative coordinates of the roll brush 2 are calculated in accordance with the absolute coordinates of the respective axes and the current coordinates, as shown in FIG. 11. The NC control interfaces 46 to 49 receive the corresponding relative coordinate data. The frequencies of the reference pulse generators of the NC control interfaces 46 to 49 are set in accordance with the rotational velocity data of the roll brush 2, thereby presetting the locus from the current point to the next point. The operation commands are simultaneously supplied to the 4-axis NC control interfaces 46 to 49. As a result, the NC control of the roll brush is performed in accordance with linear or arc interpolation. When one step is finished, the end pulses from the NC control interfaces 46 to 49 are supplied to the CPU 40, and the position pointer is incremented by one. The next point data are then read out under the control of the CPU 40, and the coordinate calculation or the line is performed again. When the above operation is repeated to complete all the steps, cleaning of one curved glass sheet is completed. The cleaning apparatus is then set in the standby state for receiving the next curved glass sheet.

The present invention is exemplified by the above embodiment. However, various changes and modifications may be made within the spirit and scope of the invention. In the above embodiment, the moving speed data of the roll brush is specified in units of teaching points (sampling points). However, NC control may be performed at a constant velocity. In addition to this modification, when the number of sampling points for teaching is sufficiently large, interpolation by NC need not be performed. In this case, the respective motors 23, 24, 37 and 21 can be controlled in response to the outputs from D/A converters which receive the teaching data.

According to the present invention as described above, both the ends of the roll brush support frame are level-shifted such that the rotating shaft of the roll brush becomes substantially parallel to the glass surface. The support frame is pivoted such that the roll brush opening of the support frame is directed substantially normal to the curved surface of the glass sheet. In addition, the roll brush or the curved glass sheet is moved such that the roll brush is moved along the glass surface. The level shift, the angular displacement and the movement of the brush are controlled in accordance with the preset data. Even if the curved glass sheet has a complicated three-dimensional surface, it can be uniformly cleaned in accordance with 4-axis control data with high precision, thereby improving the cleaning efficiency and precision. In addition, curved glass sheets having difference surfaces can be cleaned at a high speed merely by updating the control data. When the roll brush reciprocates along the surface of the curved glass sheet, no guide cam is used, thereby preventing interference between mechanical errors of the brush drive system and electrical errors in the forward and reverse directions. The cleaning control along the forward direction is independent of that along the reverse direction, hence providing satisfactory efficient cleaning for reciprocal operation.

While the described embodiment represents the preferred form of the present invention, it is to be understood that modifications will occure to those skilled in that art without departing from the spirit of the invention. The three-dimensional surface of a curved glass sheet may be a section of cylindlical surface. In this case, the height controls at both ends of the roll brush may be achieved so that one of controls along $y_a$- and $y_b$- axes depends upon the other. The identical control data will be used for both controls along $y_a$- and $y_b$-axes so that the brush roll is kept in prallel with horizontal plane and is moved along the x-axis to clean the sylindlical surface. Alternatively, the level shift mechanisms for shifting the levels of both ends of the brush roll may be mechanically coupled with each other to be controlled by a single NC controller and a single drive source.

What is claimed is:

1. A cleaning apparatus for a curved glass sheet, comprising: a roll brush for brushing a surface of the curved glass sheet; a support frame for rotatably supporting said roll brush and surrounding said roll brush, said support frame being provided with an opening for bringing part of a surface of said roll brush into contact with the surface of the curved glass sheet; first and second level shift mechanisms for respectively shifting levels at both ends of said support frame such that a rotating shaft of said support frame becomes substantially parallel to the surface of the curved glass sheet; an angular displacement mechanism for pivoting said support frame such that said opening of said support frame is directed in a direction substantially normal to the surface of the glass sheet; a moving mechanism for moving one of said roll brush and the curved glass sheet such that said roll brush is moved along the surface of the glass sheet; and a control means for controlling drive means of said first and second level shift mechanisms, said angular displacement mechanism and said moving mechanism in accordance with predetermined data.

2. An apparatus according to claim 1, wherein said first and second level shift mechanisms comprise a pair of suspension arms which are subjected to extension/-withdrawal so as to support the both ends of said support frame and extension/withdrawal drive sources for respectively driving said pair of suspension arms.

3. An apparatus according to claim 2, wherein said extension/withdrawal drive sources comprise feed screws extending along an extension/withdrawal direction of said pair of suspension arms and motors coupled to said feed screws, respectively, said pair of suspension arms being provided with portions meshing with said feed screws, respectively.

4. An apparatus according to claim 2, wherein said moving mechanism comprises a moving frame for holding proximal ends of said pair of suspension arms so as to move along the surface of the glass sheet, guiding means for guiding both sides of said moving frame along a moving direction thereof, and driving means interposed between said moving frame and a fixed portion.

5. An apparatus according to claim 2, wherein said angular displacement mechanism comprises a pair of shafts mounted to have the same axis level as that of said rotating shaft of said roll brush, bearings for supporting said shafts of said angular displacement mechanism at distal ends of said pair of suspension arms, and rotating drive means mounted at a distal end of one of said pair of suspension arms and coupled to one of said shafts of said angular displacement mechanism.

6. An apparatus according to claim 5, wherein said one of said shafts of said angular displacement mechanism is supported by a self-aligned spherical bearing at the distal end of said one of said pair of suspension arms, and the other of said shafts of said angular displacement mechanism is supported at a distal end of the other of said pair of suspension arms through a universal joint and is sequentially coupled to a worm wheel, a worm and a motor for driving said worm which constitute said rotating drive means.

7. An apparatus according to claim 1, wherein said support frame comprises a pair of bearings for rotatably supporting the both ends of said rotating shaft of said roll brush, said rotating shaft being coupled to a shaft of a roll drive motor mounted on said support frame through rotation transmitting means.

8. An apparatus according to claim 1, wherein said support frame comprises a suction pipe for drawing by suction fine particles discharged by cleaning.

9. An apparatus according to claim 1, further comprising a memory for storing data of the surface of the curved glass sheet, said control means controls said drive means for controlling a relative position between the surface of the glass sheet and said roll brush, the levels at the both ends of said roll brush and an inclination angle of said support frame in accordance with data read out from said memory.

10. An apparatus according to claim 9, wherein the data of the surface of the glass sheet comprises coordinate data of x-axis for the relative movement between the curved glass sheet and said roll brush and $y_a$- and $y_b$-axes for the levels at both ends of said roll brush, and angle data of the surface of the glass sheet with respect to a normal thereto, and said controlling means comprises a numerical control unit and a servo unit for controlling the drive means in response to an output from said numerical control unit.

11. An apparatus according to claim 10, wherein the data of the surface of the glass sheet comprises a plurality of discrete values along a moving direction of said roll brush, and said numerical control unit has a function for interpolating the plurality of discrete values in accordance with linear or arc interpolation.

12. An apparatus according to claim 10, wherein said memory further stores relative velocity data representing a relative velocity between said roll brush and the curved glass sheet, the relative velocity data being divided into x-, $y_a$- and $y_b$-axis components which serve as a part of control factors of the respective axes.

13. An apparatus according to claim 9, further comprising external operating means for manually supplying to said controlling means operating command data of the relative movement between said roll brush and the curved glass surface, the levels at the both ends of said roll brush and the inclination angle of said support frame so as to control the posture of said roll brush along the surface of a model type of curved glass sheet, the operating command data of a plurality of sampling points along the surface of the model type being stored as teaching data in said memory.

* * * * *

UNITED STATES PATENT AND TRADEMARK OFFICE

CERTIFICATE OF CORRECTION

PATENT NO. : 4,558,480

DATED : December 17, 1985

INVENTOR(S) : MASAHARU OKAFUJI, ET AL.

It is certified that error appears in the above-identified patent and that said Letters Patent is hereby corrected as shown below:

Column 7, line 27, "N (counterclockwise" to read -- N↺ (counterclockwise) --;

line 28, "N (clockwise)" to read -- N↻ (clockwise) --.

Column 9, line 17, "difference" to read -- different --;

line 32, "cylindlical" to read -- cylindrical --;

line 37, "prallel" to read -- parallel --;

lines 38-39, "sylindical" to read -- cylindrical --.

Signed and Sealed this

Sixth Day of May 1986

[SEAL]

Attest:

DONALD J. QUIGG

Attesting Officer

Commissioner of Patents and Trademarks